US006504479B1

(12) United States Patent
Lemons et al.

(10) Patent No.: US 6,504,479 B1
(45) Date of Patent: Jan. 7, 2003

(54) INTEGRATED SECURITY SYSTEM

(75) Inventors: Brian Timothy Lemons, Tampa, FL (US); Jan Ray Holliday, Maryville, IL (US); James Carrol Myers, Florissant, MO (US); Joseph Tedesco, Staten Island, NY (US)

(73) Assignees: Comtrak Technologies LLC, Hazelwood, MO (US); ADT Services AG, Schaffhausen (CH)

( * ) Notice: Subject to any disclaimer, the term of this patent is extended or adjusted under 35 U.S.C. 154(b) by 0 days.

(21) Appl. No.: 09/656,875

(22) Filed: Sep. 7, 2000

(51) Int. Cl.[7] ..... G08B 13/00

(52) U.S. Cl. ..... 340/541; 340/430; 348/143; 348/152; 348/153; 348/154; 348/155

(58) Field of Search ..... 340/541, 430; 348/143, 152, 153, 155, 154, 156

(56) References Cited

U.S. PATENT DOCUMENTS 4,006,460 A * 2/1977 Hewitt et al. ..... 340/511
4,308,911 A * 1/1982 Mandl ..... 165/209
4,511,886 A * 4/1985 Rodriguez ..... 340/534
4,532,507 A * 7/1985 Edson et al. ..... 340/5.22
4,651,143 A * 3/1987 Yamanaka ..... 340/691.1
4,750,197 A * 6/1988 Denekamp et al. ..... 455/404
4,857,912 A * 8/1989 Everett, Jr. et al. ..... 340/508
5,461,372 A * 10/1995 Busak et al. ..... 340/5.27
5,479,148 A * 12/1995 Umemoto ..... 340/539
5,936,666 A * 8/1999 Davis ..... 348/143
5,937,092 A 8/1999 Wootton et al. ..... 382/192
6,026,165 A * 2/2000 Marino et al. ..... 380/273
6,060,994 A * 5/2000 Chen ..... 340/521
6,091,771 A 7/2000 Seeley et al. ..... 375/240
6,097,429 A 8/2000 Seeley et al. ..... 348/154
6,163,257 A * 12/2000 Tracy ..... 340/506
6,275,172 B1 * 8/2001 Curtis et al. ..... 340/961

* cited by examiner

*Primary Examiner*—Julie Lieu
(74) *Attorney, Agent, or Firm*—Polster, Lieder, Woodruff & Lucchesi, L.C.

(57) ABSTRACT

An integrated security system (10) for monitoring a premises (12) to detect an intrusion onto the premises comprises a video system for providing video representations of the premises, an alarm system for providing an indication of an intrusion onto the premises, an access control system for allowing authorized entrance onto the premises, a processing device connected to the video security system, the alarm system, and the access control system for producing a signal indicative of an intrusion onto the premises, and a monitoring center connected to the processing device for receiving the signal indicative of an intrusion onto the premises.

12 Claims, 5 Drawing Sheets

INTEGRATED SECURITY SYSTEM

CROSS-REFERENCE TO RELATED APPLICATIONS

None

STATEMENT REGARDING FEDERALLY SPONSORED RESEARCH OR DEVELOPMENT

Not applicable.

BACKGROUND OF THE INVENTION

This invention relates to an integrated security system located at a site to be protected, and more particularly, to an integrated security system that combines an image based video security system, a burglar alarm system, and an access control system to detect the presence of an intrusion onto the site.

Conventional security systems are an amalgam of separate and distinct components, often provided by different vendors, which do not take advantage of similarities in function and implementation of the components. Burglar alarm systems are typically used to protect a building by employing a series of make/break contacts and sensors such as P.I.R. (passive infrared) sensors, vibration sensors, and microwave sensors, which are strategically placed at doors, windows, and other potential entry points. When any of the sensors are interrupted an alarm is sounded or relayed back to a control station located within the building, nearby the building, or remotely to a central control station of the security company employed to protect the building. Access control systems are also used to protect a building and provide for physical entry via the use of card access, facial recognition, or other identification systems. The same user may require both card access and control of the burglar alarm system such that upon entry to the building the user must proceed to the burglar alarm system control panel to disable it within a predetermined time. In addition, an in-place video security system may report alarms when motion is detected. This system may also require disabling either by the operator or via a signal from the burglar alarm control panel after the operator disables the alarm panel. Upon exit from the building, the same operator may be required to enable both the burglar alarm and video security system and to disallow entry of other personnel using the access control system. All of these systems may connect to a central monitoring station via separate communications channels such that a facility may require three phone lines to report alarm or status conditions and to receive updates of their respective databases. On site visits from three different vendors or three different personnel from the same vendor may be required to change the programming of each system.

In U.S. Pat. No. 6,069,655 there is described an image processing based video security system in which false alarm rates are substantially eliminated by implementation of image processing techniques such as described in co-assigned U.S. Pat. Nos. 5,937,092 and 5,956,424. 6,097,429 and 6,091,771 respectively describe a site control unit and a workstation for use with the system. A key feature of the security system is detection of motion in an image obtained from a video camera, processing of the image to determine if the motion is true motion as opposed to the perceived effects of lighting changes or the like, and if true motion, the classification of the source of that motion as being of a target class or of a different class. Image processing, motion detection, and image classification are all performed onsite by the site control unit with an alarm being provided to a monitoring location only if detected motion is classified as caused by the target class.

The separate implementations of functions may be traced to the historical use of such systems for different purposes, the cost of implementing such systems, and the relatively recent advent of video security systems. The present invention takes advantage of recent advances in computer power and software to eliminate the redundancies between systems and eliminate the necessity of separate communications channels for each system.

This invention relates to an integrated security system physically located at a site being protected. The integrated security system contains the functionality of any or all components of a burglar alarm, an access control system, and a video security system. Whereas it is common to find separate and distinct burglar alarm, access control, and video systems and components at any location, an integrated security system of the present invention is unique. The integrated security system includes a site control unit which is capable of locally controlling all aspects of the burglar alarm system, the access control system, and the video security system, provides a common database for reducing redundancies in the control of all of the systems, and provides a common communications channel for alarm reporting and exchange of information with a remote monitoring center.

BRIEF SUMMARY OF THE INVENTION

Among the several objects of the invention may be noted the use of an integrated security system to control all aspects of the burglar alarm, access control, and video security functions positioned at a facility to be protected or monitored. The integrated security system may be locally controllable by an operator or security personnel at the site, or by remote control from a control center located some distance away. The remoteness of the control center may be substantial; i.e., transcontinental, without the performance of on-site security being effected, or with the outputs from the site to the remote control center being degraded in any manner.

Another object of the invention is the provision of a common database for control of a combined burglar alarm, access control, and video security system. The common database containing information related to user IDs, access control numbers, times of operation, entry and exit delays, allowed personnel for access and control of the functions of the system, and other related information used by the integrated system to control the operation of the system and the reporting of alarms. The use of the common database reduces the need for operator intervention and changing of parameters separately for each function of burglar alarm, access control, and video security employed in the integrated security system.

A third object of the invention is the use of a common communications channel for exchange of information and the reporting of alarms from the combination of the burglar alarm system, the access control system, and the video security system. The communications channel is capable of only being used so long as required to send and receive appropriate data and instructions or to report an alarm to the remote monitoring center.

A further object of the present invention is to provide an integrated security system which can be remotely programmed or have associated software which can be easily upgraded.

Another object of the invention is to provide the control of a burglar alarm system which may include, but not be limited to, the sensing of any device which indicates an alarm condition such as make/break contacts, PIR devices, radar detectors, etc. The integrated security system is also capable of reporting the indicated alarm conditions, and controlling the times when the burglar alarm system is active, including entry and exit delays.

Another object of the invention is to provide an integrated security system which is capable of controlling a video security system which may include, but not be limited to, the sensing of any motion which indicates an alarm condition, the recording of video images for local or remote viewing, including snapshots and video recordings, the recording of audio, the ability to look at live video and listen to live audio remotely via the communications channel, the ability to send live audio or a recorded announcement, and the ability to transfer any video or audio recording over the communications channel. The video security system includes as inputs a single or a plurality of image and audio generating devices either visual, infrared, ultraviolet or radar images and acoustic devices not necessarily limited to the range of human vision or hearing.

A further object of the invention is to provide an integrated security system which can control an access control system which may include, but not be limited to, allowing access only during certain hours of operation, allowing access to designated personnel, reporting of unauthorized access attempts, and storing a history of access personnel and times.

The integrated security system of the present invention is also capable of having a common interface which is used to control all of the functions or operations of the video security system, the alarm system, and the access control system from a monitoring center or a remote control station. Additionally, the monitoring center or the remote control station may include a common database to store information relating to the alarm system, the access control system, and the video security system. The monitoring center may further have a single workstation which is capable of accessing all of the features and functions of the burglar alarm system, the access control system, and the video security system.

These and other objects and advantages of the present invention will become apparent after considering the following detailed specification in conjunction with the accompanying drawings, wherein:

DETAILED DESCRIPTION OF THE INVENTION

Figure 1:
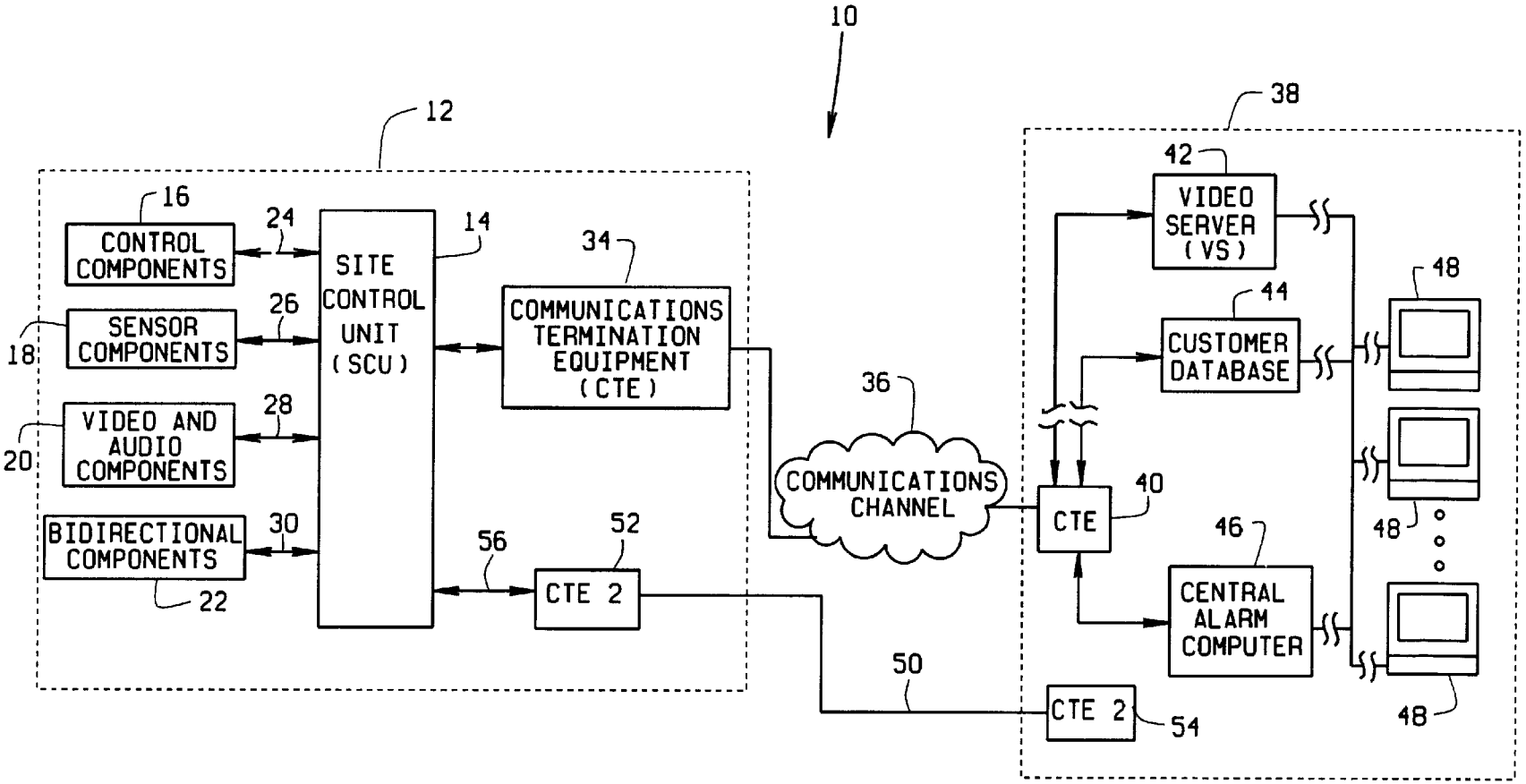
FIG. 1 is a block diagram of an integrated security system constructed according to the present invention.

Referring to the drawings, wherein like numbers refer to like items, number 10 identifies a preferred embodiment of an integrated security system constructed according to the present invention. FIG. 1 shows the integrated security system 10 which is used to monitor an installation, a building, or a facility 12 to detect the presence of an intrusion. Within the facility 12 is a site control unit (SCU) 14 and connected to the SCU 14 are control components 16, sensor components 18, video and audio components 20, and bidirectional components 22. The control components 16, sensor components 18, video and audio components 20, and bi-directional components 22 are all connected to the SCU 14 via connections 24, 26, 28, and 30, respectively. For example, the connection 28 may be video cable with control signals being RS-232 or RS-485.

The SCU 14 further provides an output over a connection 32 through communications termination equipment (CTE) 34. The connection 32 may be through an Ethernet type cabling system. The CTE 34 transmits and receives signals over a communications channel 36 to and from a monitoring center 38. An individual or an operator (not shown) is located within the monitoring center 38 to determine if an intrusion has been detected at the facility 12 or to examine the status of the facility 12. The operator evaluates information provided from the SCU 14 to determine if police, fire, medical, or other authorities need to be contacted. The monitoring center 38 includes communications termination equipment 40 which is connected to a video server (VS) 42, a customer database 44, and a central alarm computer 46, which are all interconnected with a plurality of workstations 48. The workstations 48 are used to display video images, control recording of the video images, display alarms, display contact data or information, display and modify customer data or other information to service alarms, manage the customer database 44, and to communicate with and control the SCU 14. The VS 42, customer database 44, central alarm computer 46, and the workstations 48 may be interconnected using an Ethernet type connection system or network. Examples of the constructions and functions of the VS 42, the central alarm computer 46, and the workstations 48 are disclosed in U.S. Pat. No. 6,069,655, which is incorporated herein by this reference. The customer database 44 may be any commercially available or a custom software product or package which may be configured to include information concerning the owner of the facility 12, the location or address of the facility 12, and who should be contacted in the event of an alarm or an intrusion. Further, the database 44 may be used to provide non-video information to the display associated with the workstation 48. For example, the workstation 48 will be provided with video images from the video security system and the database 44 can provide information corresponding to the video images. Additionally, the customer database 44 may be included in the central alarm computer 46. Although a number of workstations 48 have been shown, it is also possible to having only one workstation 48 in the monitoring center 38.

In addition to the common communications channel 36, a backup or redundant communications channel 50 may be employed. The channel 50 is connected between the facility 12 and the monitoring center 38 by using communications termination equipment (CTE2) 52 located within the facility 12 and communications termination equipment (CTE2) 54 located within the monitoring center 42. The CTE2 52 may be connected to the SCU 14 via a connection 56. Although not shown, the CTE2 54 may be connected to the video server 42, the customer database 44, and the central alarm computer 46 as the CTE 40. Thus all functions of the integrated security system 10 can be maintained even when the primary communications link 36 fails, is not available, or is interrupted. Examples of the communications termination equipment 34, 40, 52, and 54 may be an ISDN router or a phone line dial-up.

An important feature of the present invention is the use of the single or common communications channel 36 to control and communicate with all features and functions of the SCU 14 and the components 16–22. The communications channel 36 may be any convenient channel including standard telephone service, ISDN, DSL, Internet, dedicated cable, local area network, wide area network, wireless, or any communications channel available to connect between the SCU 14 and the monitoring center 38. The actual channel is immaterial as long as sufficient capability exists to transfer video, audio, command, control, and data at the required rates. The communications channel 50 may be the same as the communications channel 36. However, the communications channel 36 will be a high speed channel or a high speed connection while the communications channel 50 may be a phone line. A second feature of the invention is the use of a common database within the SCU 14 for all data related to the operation and control of the components 16–22. A third feature of the invention is the use of the customer database 44 at the monitoring center 38 which is used to store and manage all data for the components 16–22 located at the customer premises 12. A fourth feature of the invention is the use of a single workstation interface at the monitoring center 38 to access all the features and functions of components 16–22. A fifth feature of the invention is the combining of all of the functions of previously separate systems such as a video security system, a burglar alarm system, and an access control system into the integrated security system 10 such that individual video security, burglar alarm, and access control functions may not be distinguishable although they are presented here as individual functions to better illustrate the concepts.

Figure 2:
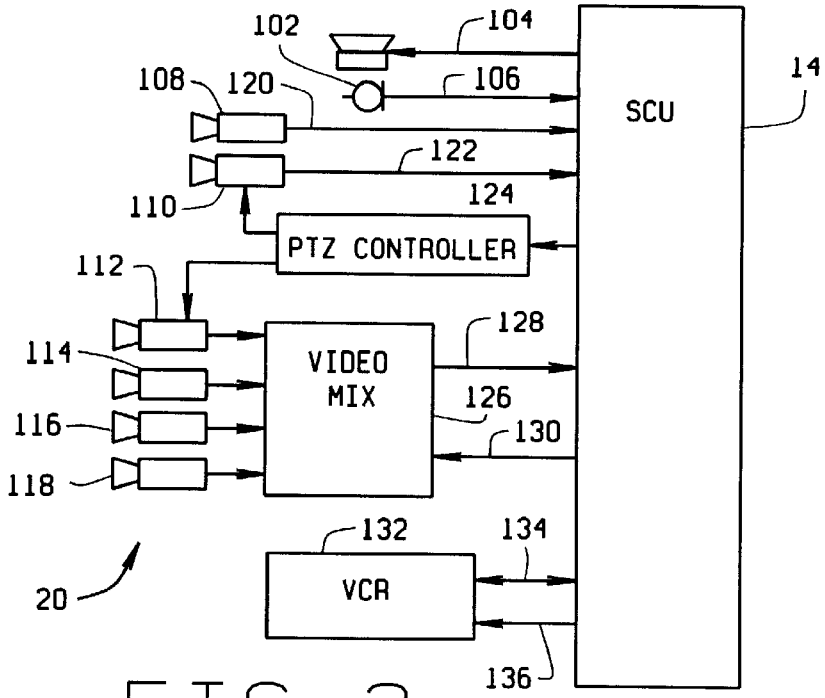
FIG. 2 is a block diagram of video and audio components associated with the integrated security system.

With reference now to FIG. 2, a detailed block diagram of the video and audio components 20 are illustrated. A speaker 100 and a microphone 102 are connected to the SCU 14 via connections 104 and 106, respectively. The speaker 100 is used to play a recorded message or for an operator to issue an audio or verbal message in the facility 12. The microphone 102 is used to allow the operator to listen for any sounds inside or outside the facility 12. A plurality of cameras 108, 110, 112, 114, 116, and 118 are connected to the SCU 14 in various ways. For example, the camera 108 is directly connected to the SCU 14 via a connection 120. Video signals from the camera 108 are sent directly over the connection 120 to the SCU 14. The camera 110 is also connected directly to the SCU 14 via a connection 122. However, movement of the camera 110 may be controlled by a pan, tilt, and zoom (PTZ) controller 124. The PTZ controller 124 allows the SCU 14 to control the movement of the camera 110 to obtain the best possible image. The cameras 112-118 are connected to the SCU 14 through a video mulitplexor (MUX) 126 and are also controlled by the PTZ controller 124. The video MUX 126 allows for the selection of one of the cameras 112–118 for viewing purposes. Additionally, a selection of a composite image from a combination of the cameras 112–118 may also be selected. For example, the images from the cameras 112–118 may be presented as a single image in a quad format on a display of the workstation 48. The video MUX 126 is connected to the SCU 14 via a connection 128 which provides video images from the cameras 112–118 to the SCU 14. Another connection 130 is provided from the SCU 14 to the video MUX 126 to control the operation of the video MUX 126. A video cassette recorder (VCR) 132 is also connected to the SCU 14 via a connection 134. Video images may be sent to the VCR 132 or received from the VCR 132 over the connection 134. Another connection 136 connects the SCU 14 to the VCR 132 to control the operation of the VCR 132.

It should be understood that not all of the video and audio components may be present in any facility 12 and that other similar components may be used, although such components have not been specifically shown or described. Additionally, the number of components which have been depicted may change dependent upon the particular requirements of the facility 12. For example, although four cameras 112–118 are shown, it is possible to have more cameras connected to the video MUX 126. As is known, the output of the cameras 108–118 may be digital or analog, color or black and white, and the frame rate of each of the cameras 108–118 is determined by the camera type.

Figure 3:
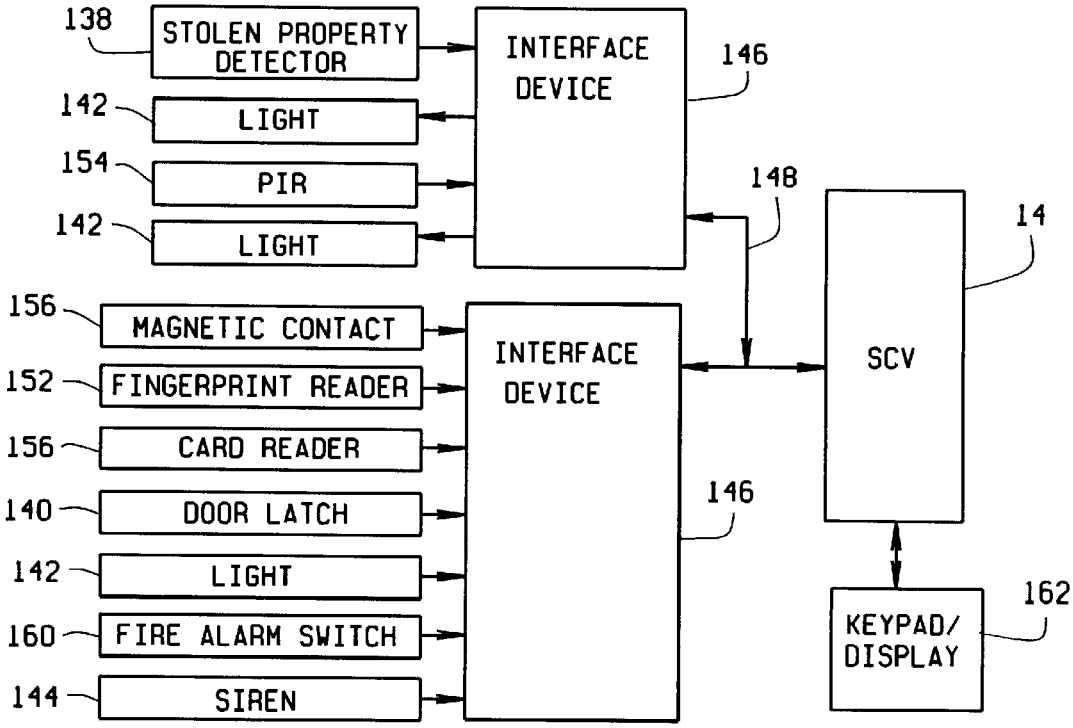
FIG. 3 is a block diagram of sensor and control components associated with the integrated security system

FIG. 3 depicts a detailed block diagram of the control components 16, the sensor components 18, and the bidirectional components 22. The control components 16 may comprise output devices such as a door latch 140, a light 142, and a siren 144. The control components 16 are connected through one or more interface devices 146 to the SCU 14 via a connection 148. The connection 148 may use a standard type interface such as RS-232 or RS-485. The interface devices 146 are used to convert signals between the formats used by the SCU 14 and the components 140, 142, and 144. Not all of the components 140–144 need to be used in the facility 12 and other similar components may be used although not specifically identified.

The sensor components 18 are shown to comprises a card reader 150, a fingerprint reader or scanner 152, a passive infrared detector (PIR) 154, a magnetic contact 156, a stolen property detector 158, and a fire alarm switch 160. Other type sensors (not shown) may be used as part of the sensor components 18. For example, smoke detectors, alarm pulls, and motion detectors may be used. Again, not all of the components 150–160 may be required in the facility 12. Additionally, there may be a plurality of these components 150–160 in the facility 12.

The bi-directional components 22 may comprise a keypad/display device 162 which is used to enter information and read data from the system 10. The device 162 may control all of the functions of the system 10 within the facility 12. For example, the keypad/display device 162 may be used to control a burglar alarm system in the facility 12. The device 162 may arm or disarm the burglar alarm system. Further, the device 162 may be used to gain access into the facility 12. The device 162 is directly connected to the SCU 14 without the need of an interface device 146.

Figure 4:
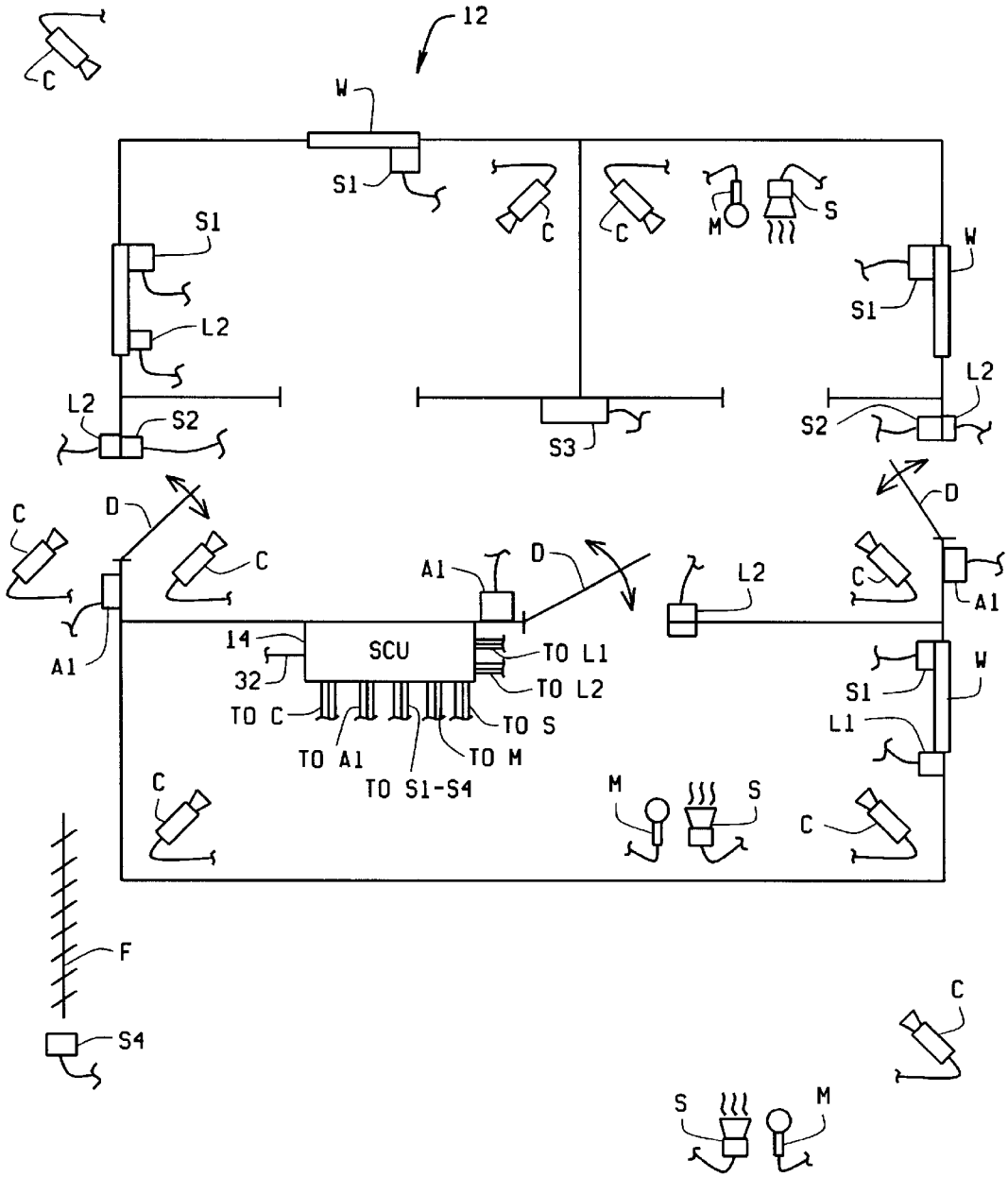
FIG. 4 is a representation of a facility in which the integrated security system of the present invention is installed.

Referring now to FIG. 4, the facility 12 is representative of the type of location, premises, or building with which the integrated security system 10 is employed is shown. In particular, the facility 12 has windows W and doors D which need to be monitored to determine if an intrusion is occurring or has occurred. The windows W may, for example, be provided with sensors S1 and each of the doors D with a sensor S2. Each door D may also be provided with an access control unit A1. The windows W and/or doors D may also be provided with lights L1, door locks L2, or other actuators that are controlled via the SCU 14 located on the premises 12. Both sensors S1 and S2 may be conventional make/break sensors, although sensor S1 may be a vibration sensor. A motion sensor S3 may be installed in a passage through the facility 12 to detect movement of an individual through the passage. This may be passive infrared, radar, or other type. A sensor S4 may be used to detect vibration near a perimeter fence F. The sensor S4 may also be a laser beam or other intrusion means. Sensors S1–S4, access control unit A1, lights L1, and actuators L2 are all well known in the art. Although the interface between the sensors S1–S4, the access control unit A1, the lights L1, the actuator L2, and the SCU 14 has been described as being via RS-485 interface boxes, it is also possible to have a direct connection to the SCU 14 or a connection via other interfaces such as RS-232. A plurality of video cameras C is strategically located both inside and outside the facility 12. Outputs from the cameras C are routed to the SCU 14 via the connections, such as the connections 120, 122, or 128 shown in FIG. 2. Additionally, the outputs from the access control panels A1, the sensors S1–S4, the lights L1, and the actuators L2 are transmitted to the SCU 14 via the connections.

If any of the sensors S1–S4, the actuators L2, or the access control panels A1 detects an intrusion into the facility 12, an alarm signal is sent from the SCU 14 through the CTE 34 and the communications channel 36 to the CTE 40 in the monitoring center 38. An operator, located at the monitoring center 38, may request to view video from the cameras 108–118, to verify the presence of an intrusion. This allows the operator to reject the alarm if no visual identification or verification of the threat can be made. Alternatively, if the operator determines that the threat condition does exist, then the appropriate authorities may be contacted. In addition, due to the integrated nature of the SCU 14, the operator may control certain actions, such as turning the lights L1 on or opening or closing the locks L2. The system 10 may also have positioned or located at the facility 12 speakers S, such as the speakers 100, and microphones M, such as the microphones 102, which are connected to the SCU 14. The speakers S may be used for playing a recorded message or for an operator to issue an audio or verbal message. The microphones M are employed to allow the operator to listen for any sounds within or outside of the facility 12. Any audio signals picked up from the microphones M may help to verify an intrusion. Further, the speakers S and the microphones M may be incorporated into any of the cameras 108–118.

The SCU 14 can intelligently look at video provided by each of the cameras C to determine if an intruder is present within any of the areas in the field of view of the cameras C. If it is determined that this is so, the SCU 14 sends an alarm signal to the monitoring center 38 in order for the operator to investigate. In this manner, the operator does not have to continuously monitor unchanging video with which there is a low probability of an intrusion. In addition, due to the integrated nature of the system 10 the operator may command certain actions such as turning one or more of the lights L1 on, playing a recorded announcement over the speakers S, removing access control privileges from the access control panels A1, examining the status of other sensors S1–S4, or otherwise controlling the customer premises equipment as the situation warrants.

The access control panels A1 may be conveniently located on the premises 12 such that when the sensors S1–S4 are armed and someone enters the premises 12, the person can enter an appropriate code at the nearest panel A1 to signify that the entry is authorized, no intrusion has occurred, and hence no false alarm condition exists. Additionally, entry of an appropriate code may also disarm the cameras C, the sensors S1–S4, or disarm preselected zones or areas within the facility 12. Alternatively, due to the integrated system 10, when someone enters the premises using the access control panels A1, the cameras C may send a signal to the monitoring station 38 for an operator to visually verify that the person seeking entrance to the facility 12 is authorized. Those skilled in the art will appreciate that many such synergies in operation will accrue from the integrated security system 10. For example, if the vibration sensor S4 is activated due to a storm or other natural circumstance, the cameras C may be activated to verify the alarm condition. If no alarm condition is detected, then no alarm is sent to the monitoring center 38. As another example, consider that those authorized to access the system 10 may use passkeys or other means which may be lost or stolen. A digital recorder integrated within the SCU 14 may record every person who enters the building 12 using the access control panels A1. The video can be indexed via the access code and time to provide a means to verify the entry of the person using the passkey was in fact the owner of the key. This may also prevent users from "loaning" their key to unauthorized personnel or allowing unauthorized personnel access to the facility 12 if they are aware that there is a video record of every entry. Also, the stolen property detector 158, which is also known as an electronic article surveillance device or sensor (EAS), can be used in combination with the digital recorder to record and tag the video whenever the detector 158 is activated.

In addition to the alarm advantages, the integrated system 10 presents advantages for remote access when no alarm condition exists. The operator to located at the monitoring center 38 can command the SCU 14 to cycle through the cameras C under its control to execute a "walk about" of the premises 12 as detailed in U.S. Pat. No. 6,097,429, entitled "Site Control Unit for Video Security System". In addition, the condition of each of the sensors S1–S4, the lights L1, the actuators L2, the cameras C, the speakers S, and the microphones M may be examined. This allows for the reduction in needed guard services as further described and detailed in U.S. Pat. No. 6,097,429.

Figure 5:
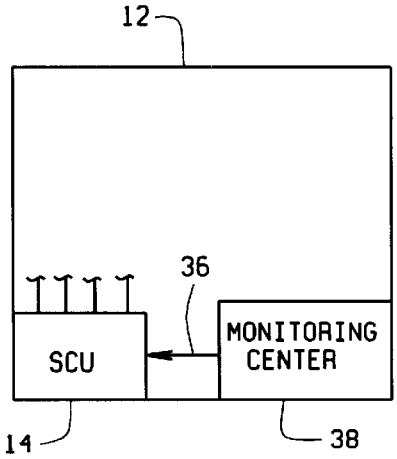
FIG. 5 is a simplified representation of the integrated security system having a single site control unit used in conjunction with a local monitoring station.
Figure 6:
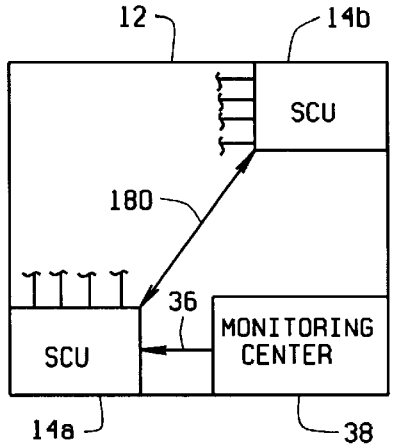
FIG. 6 is a simplified representation of the integrated security system having multiple site control units used in conjunction with a local monitoring station.

Although the integrated security system 10 has thus far been illustrated and described as being at a facility 12 and a monitoring center 38 which are remote from each other, the system 10 can be configured in a variety of ways using one or more SCU's 14. In FIG. 5, both the SCU 14 and the monitoring center 38 are located at the same site or within the facility 12. The SCU 14 is connected to the monitoring center 38 by the communications channel 36. Depending on the amount of monitoring utilized at a site 12, two or more SCUs, 14*a* and 14*b*, for example, may be located at the site 12 and both SCUs 14*a* and 14*b* are locally controlled from the same monitoring center 38. This arrangement is shown in FIG. 6. Further, the monitoring center 38 may be connected to the SCU 14*a* by the communications channel 36. The SCU 14*a* serves as a primary SCU and is connected to the SCU 14*b*, which serves as a secondary SCU, by a connection 180.

Figure 7:
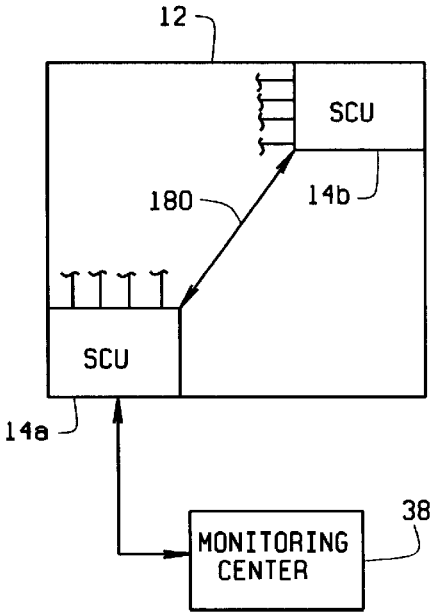
FIG. 7 is a simplified representation of the integrated security system having multiple site control units used in conjunction with a remote monitoring station.
Figure 8:
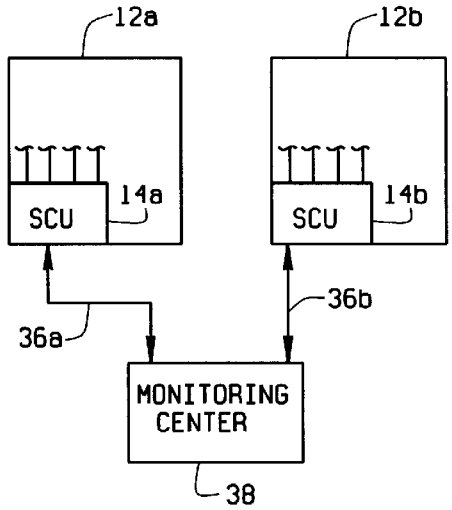
FIG. 8 is a simplified representation of the integrated security system having two different facilities used in conjunction with a remote monitoring system.

FIGS. 7 illustrates the situation where two or more SCU's 14*a* and 14*b* are located at the site 12 and the monitoring center 38 is at a remote location. The SCU's 14*a* and 14*b* can be remotely operated or controlled from the monitoring center 38 over the communications channel 36. Again, the SCU 14*a* serves as the primary SCU and the SCU 14*b* serves as the secondary SCU. The SCU's 14*a* and 14*b* are connected via the connection 180. An example of two different facilities 12*a* and 12*b* being monitored by a single remote monitoring center 38 is shown in FIG. 8. The monitoring center 38 is connected to each of the facilities 12*a* and 12*b* via communications channels 36*a* and 36*b*, respectively. Within each of the facilities 12*a* and 12*b* are SCU's 14*a* and 14*b*. In this manner, a single remote monitoring center 38 can monitor and control the site control units 14*a* and 14*b* in different facilities 12*a* and 12*b*. As can be appreciated, there are various other configurations of the integrated security system 10 which are possible and contemplated.

Figure 9:
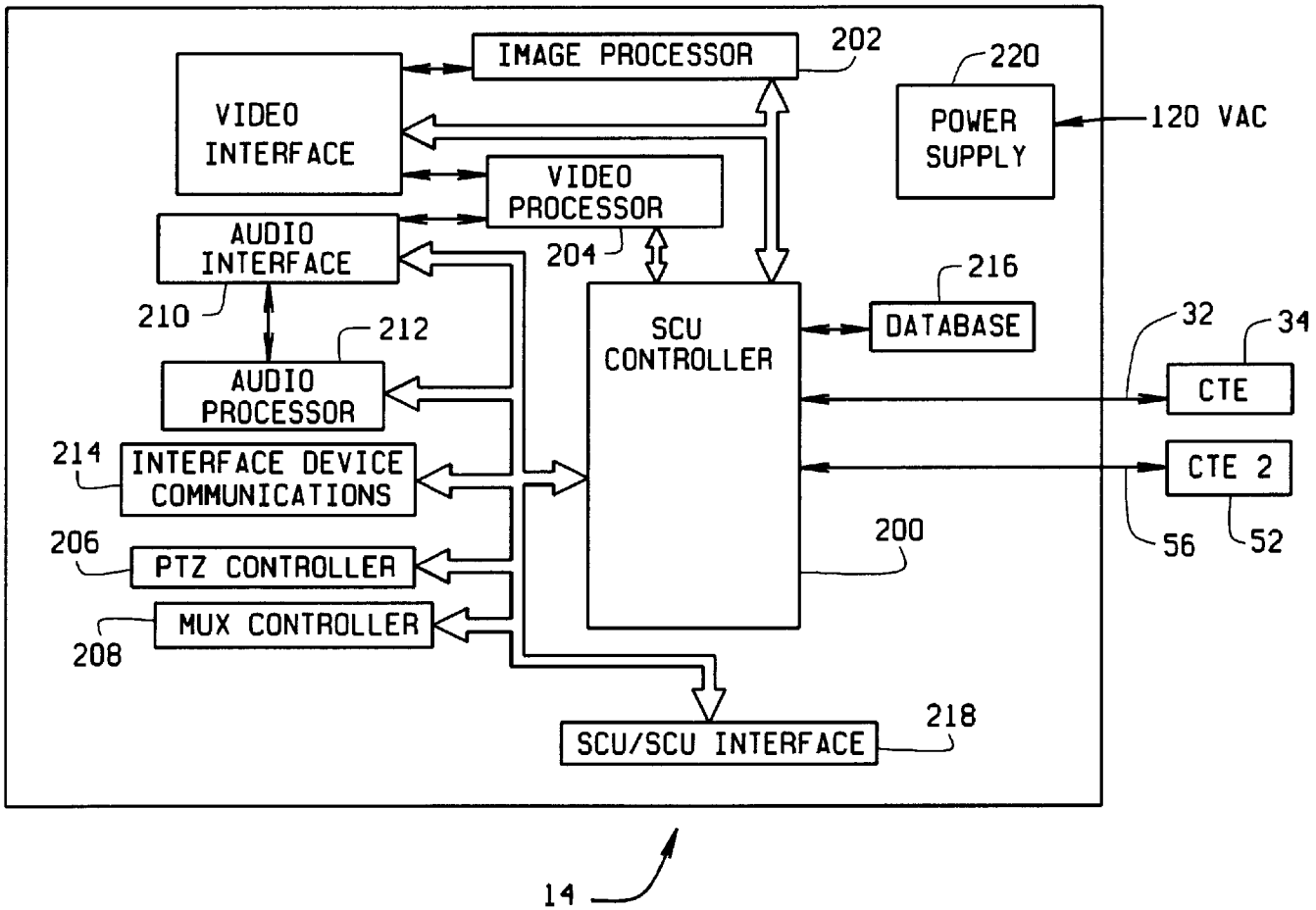
FIG. 9 is a block diagram of a site control unit of the integrated security system of the present invention.

With reference now to FIG. 9, a block diagram of the site control unit 14 is shown. The site control unit 14 comprises an SCU controller 200 which is connected to an image processor 202 and a video processor 204. Both of these processors 202 and 204 are disclosed in U.S. Pat. Nos. 6,069,655 and 6,097,429, which such disclosures being incorporated herein by these references. The controller 200 is further connected to a PTZ controller 206 and a MUX controller 208. In this manner, video signals or images may be received by the controller 200 from any of the cameras 108–118 or C located at a facility 12 and control signals may be sent to the cameras C or the PTZ controller 124. The SCU controller 200 is also connected to an audio interface 210 and an audio processor 212. This allows the controller 200 to send signals to the speakers S or receive signals from the microphones M. An interface device communications device 214 is connected to the controller 200 which allows the controller 200 to communicate with the interface devices 146. As has been discussed, the interface devices 146 are connected to various components such as the door latch 140, the lights 142, the siren 144, the card reader 150, the fingerprint reader 152, the PIR 154, the magnetic contact 156, and the stolen property detector 158.

The controller 200 further comprises an associated database 216. The database 216 may be used to store information related to user IDs, access control numbers, times of operation, entry and exit delays, allowed personnel for access and control of the functions of the system 10, the location of the sensors S1–S4, lights L1, actuators L2, access control panels A1, cameras C, speakers S, and microphones M located at a particular facility 12. The controller 200 also has an SCU/SCU interface 218 for connecting the SCU 14 to one or more other SCU's 14. For example, the SCU 14 may serve as the primary SCU within the facility 12 and the interface 218 is used for sending and receiving signals from one or more other SCU's 14 at the facility. As discussed above, these other SCU's 14 serve as secondary SCU's.

The controller 200 is also capable of transmitting and receiving information over the connection 32 through the CTE 34. The CTE 34 is in turn connected to the communications channel 36, although such connection is not illustrated in FIG. 9. The CTE2 52 is connected to the SCU controller 200 via the connection 56. In case the channel 36 is broken, interrupted, or otherwise impaired, the controller 200 is connected to the monitoring center 38 via the CTE2 52 and the communications channel 50. A power supply 220 is provided as part of the SCU 14 and the supply 220 is connected to a standard 120 VAC source.

The SCU controller 200 may take various forms. For purposes of example only, the controller 200 may include a microprocessor based system having memory means, storage means, and other associated circuitry. The controller 200 may be constructed from off the shelf components or such components may be custom made for the specific application. The controller 200 may include a program that controls the various operations of the controller 200 and the SCU 14. It is also possible that the database 216 may be incorporated into the controller 200 thereby reducing the number of actual components required for the SCU 14.

In operation, the controller 200 is capable of responding to commands from one of the workstations 48 located at the monitoring center 38. For example, if the SCU 14 determines that an alarm condition is present, such as one of the sensors S1 being opened which corresponds to one of the windows W being opened, then a signal is provided to the controller 200. The controller 200 is programmed to take several actions at this point. One such action would be to check the database 216 to determine the location of the window W. Once the location is determined, the controller 200 can turn on one of the cameras C positioned at that location. The controller 200 can then receive video images from the camera C and send such images to the monitoring center 38 over the communications channel 36. Further, prior to sending the images, the controller 200 can determine if the intrusion should be a true alarm condition. For example, the initially sensed intrusion may be a cat in the facility 12 which may not pose a security risk. In this situation, the controller 200 can differentiate between human and non-human motion and not submit an alarm signal or indication to the monitoring center 38. The controller 200 is also capable of sending images from the cameras C to the monitoring center 38 or to the VCR 132 for recording of these images for later use.

It is a particular feature of the controller 200 to process acquired images or video from the cameras C in order to detect an actual intrusion onto the facility 12 and to inform an operator located at the monitoring center 38 of such an event, while not providing false alarms. When an intrusion is detected by the controller 200, a wide bandwidth communications channel 36 is established between the controller 200 and the monitoring center 36 for transmission of full resolution snapshots or compressed video images of the intrusion for viewing at the monitoring center 36. The operator, at one of the workstations 48, can select snapshots for viewing and can create a mosaic of snapshots for review. The snapshots or the video images may be stored for later use and review.

There are a number of other features concerning the SCU 14 that are important for the overall operation and performance of the integrated security system 10. First, while the SCU 14 is normally powered from the standard 120 VAC supplied to the facility 12, the SCU 14 is also connected to an uninterrupted power supply (UPS). The UPS (not shown) maintains power to the SCU 14 for prolonged periods of time if there is a power failure, thus enabling the SCU 14 to fully perform its operations. Second, to ensure that the video input to the SCU 14 has not been tampered with, the SCU 14 performs a self-check procedure to verify that a video signal is present, that there is content from the scene being observed, and that the source is from the desired camera. Third, the SCU's 14 utilized a substantial amount of software, the SCU's 14 are designed to facilitate remote upgrading and updating of its software from the monitoring center 38. With the SCU's 14 being remotely located over a wide territory, it would be cumbersome to individually access each SCU 14 to upgrade or update the different software employed by the SCU 14. The monitoring center 38 can provide the upgraded or updated software over the communications channel 36.

The cameras 108–118 and C are preferably television cameras. It will be appreciated by those skilled in the art that the cameras 108–118 may be black and white cameras, color cameras, or a combination of both may be used in the facility 12. The cameras 108–118 may conform to an analog television format standard such as the RS 170 or CCIR standards, or the camera input may be digital. Depending upon the area where the cameras 108–118 are located and positioned, some or all of the cameras 108–118 may be low light cameras. The cameras 108–118 also do not need to operate in the visible portion of the light spectrum. The cameras 108–118 may include IR (infrared) cameras or UV (ultra violet) cameras depending upon the application. The image provided from the cameras 108–118 may be created from the RF (radio frequency) portion of the spectrum in which instance such cameras may be high resolution SAR images, or an acoustic image can be produced from the acoustic portion of the spectrum. It will be understood that while an installation will typically employ only one type of camera 108–118 (black and white or color TV cameras, for example), the SCU 14 can process images created from a combination of all of the cameras 108–118 or image sensors discussed above and employed at the same time in the facility 12. As use of the facility 12 changes, for example warehouse space is changed to office space, one type camera can be replaced with another type camera without effecting the overall performance of the SCU 14.

What has been described is an integrated security system 10 which is used to monitor and control various video functions, alarm functions, and access control functions located at a facility 12. A monitoring center 38 may be positioned or located either locally or remote from the facility 12. The integrated security system 10 also comprises a site control unit 14 and any facility 12 being monitored may include one or more site control units 14. The site control unit 14 can accommodate a plurality of cameras C which can be color, black and white, and analog or digital. The cameras C have pan, tilt, and zoom capabilities and the cameras C also have high resolution video. Audio acquisition can also be employed at the facility 12 and acquired audio is interleaved with processed video to provide a system operator both visual and audio monitoring capabilities.

Monitoring of status of the integrated security system 10 includes determining whether the sensors are functioning properly may be handled or performed by the SCU 14. In this manner, the status of the integrated system 10 is constantly being monitored without intervention from the monitoring center 38. In the event of a component or sensor failure, any of the cameras C may be armed to cover the location of the failed device.

From all that has been said, it will be clear that there has been shown and described herein an integrated security system which fulfills the various objects and advantages sought therefor. It will be apparent to those skilled in the art, however, that many changes, modifications, variations, and other uses and applications of the subject integrated security system possible and contemplated. All changes, modifications, variations, and other uses and applications which do not depart from the spirit and scope of the invention are deemed to be covered by the invention, which is limited only by the claims which follow.

What is claimed is:

1. An integrated security system for managing the security of a premises to detect an intrusion onto the premises comprising:

visual means for visually monitoring the premises and for providing a video signal indicative of an intrusion;

alarm means for determining whether an intrusion onto the premises has occurred, the alarm means providing a signal indicative of an intrusion;

access control means for providing authorized access onto the premises, the access control means providing a signal indicative of an unauthorized access;

processing means interconnected with the visual means, the alarm means, and the access control means, the processing means producing a signal indicative of an intrusion onto the premises in response to receiving a signal from the visual means, the alarm means, or the access control means; and monitoring means connected to the processing means for receiving the signal indicative of an intrusion onto the premises, the monitoring means comprising a workstation having a video display means capable of displaying the video signal, and further comprising a database which provides non-video data corresponding to the video signal being displayed by the video display means.

2. The integrated security system of claim 1 wherein the processing means comprises control means for controlling operation of the visual means, the alarm means, and the access control means.

3. The integrated security system of claim 2 wherein the monitoring means is capable of accessing the control means to control operation of the visual means, the alarm means, and the access control means.

4. The integrated security system of claim 1 wherein the processing means comprises means for checking the status of the visual means, the alarm means, and the access control means.

5. The integrated security system of claim 1 wherein the processing means comprises means for storing information corresponding to user IDs, access control numbers, times of operation, entry and exit delays, allowed personnel for access and control of the functions of the system, the location of the visual means, the alarm means, and the access control means in the premises.

6. The integrated security system of claim 1 wherein the processing means comprises a storing means for storing data corresponding to user IDs, access control numbers, times of operation, entry and exit delays, allowed personnel for access and control of the functions of the system, the location of the visual means, the alarm means, and the access control means in the premises and the monitoring means comprises means for updating the data in the storing means.

7. The integrated security system of claim 1 further comprising a first communications channel connected between the processing means and the monitoring means for transmitting and receiving signals to and from the processing means and the monitoring means.

8. The integrated security system of claim 7 comprising a second communications channel connected between the processing means and the monitoring means for transmitting and receiving signals to and from the processing means and the monitoring means.

9. The integrated security system of claim 8 wherein the second communications channel is used whenever the first communications channel is not available.

10. The integrated security system of claim 1 wherein the processing means further comprises control means, the control means determining whether a signal indicative of an intrusion has been received from the alarm means, and once received, the control means controlling operation of the visual means for verifying an intrusion.

11. The integrated security system of claim 10 wherein the control means further comprises means for controlling operation of the access control means.

12. The integrated security system of claim 1 further comprising a common, local data entry device for arming and disarming the alarm means.

* * * * *